United States Patent [19]

Hasselbacher

[11] 4,129,185

[45] Dec. 12, 1978

[54] FIRE SUPPRESSION SYSTEM

[75] Inventor: Roland E. Hasselbacher, Brimfield, Ill.

[73] Assignee: Caterpillar Tractor Co., Peoria, Ill.

[21] Appl. No.: 815,954

[22] Filed: Jul. 15, 1977

[51] Int. Cl.[2] ..... A62C 3/00

[52] U.S. Cl. ..... 169/62

[58] Field of Search ..... 169/61, 62

[56] References Cited

U.S. PATENT DOCUMENTS

| | | | |
|---|---|---|---|
| 1,630,251 | 5/1927 | Bechard | 169/62 X |
| 1,744,733 | 1/1930 | Beames | 169/62 |
| 2,015,995 | 10/1935 | Egtvedt | 169/62 X |
| 3,688,846 | 9/1972 | Lease | 169/62 |
| 3,762,477 | 10/1973 | Mobley, Sr. | 169/61 |

*Primary Examiner*—Robert W. Saifer

*Attorney, Agent, or Firm*—John L. James

[57] ABSTRACT

A fire suppression system for a machine includes a source of pressurized fire extinguishing fluid. Apparatus is provided for controllably directing the fluid to preselected areas of the machine and automatically stopping the machine in response to release of the fluid.

9 Claims, 5 Drawing Figures

FIRE SUPPRESSION SYSTEM

BACKGROUND OF THE INVENTION

Many machines, such as wheel loaders for example, use combustible fuels and lubricants to fuel the engine and lubricate the transmission. The engine and transmission become heated during normal operation and are exposed to the atmosphere. Where there are combustible materials, heat and air, there exists a potential danger of fire. In the case of an engine fire, it is desirable to stop the engine and the flow of fuel to it as well as shut off the supply of air. It is desirable to maintain the engine stopped until the fire is extinguished and the fire suppression system is readied for another operation.

SUMMARY OF THE INVENTION

The present invention is directed to overcoming one or more of the problems as set forth above.

According to the present invention, a fire suppression system for a machine comprises a source of pressurized fire extinguishing fluid and means for controllably directing the fluid to preselected areas of the machine. Means are provided for automatically stopping the machine and maintaining the machine stopped in response to controlled release of the fluid.

DETAILED DESCRIPTION

Figure 1:
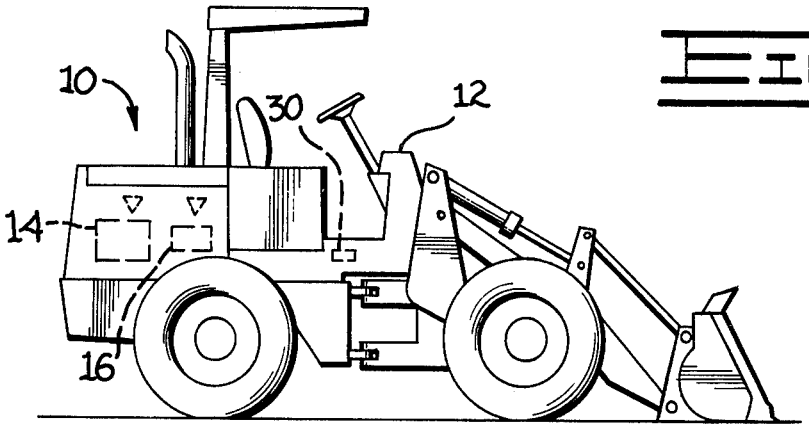
FIG. 1 is a side view of wheel loader employing the present invention.

Referring to FIG. 1, a fire suppression system 10 is provided for a machine, such as a wheel loader 12, for example. The wheel loader 12 has an engine 14 and transmission 16 which use pressurized, combustible fluids.

Figure 2:
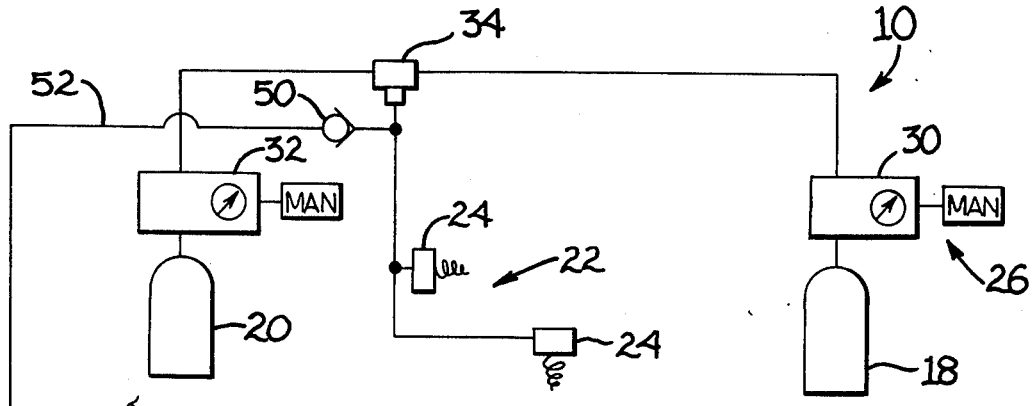
FIG. 2 is a schematic illustration of the present invention.
Figure 3:
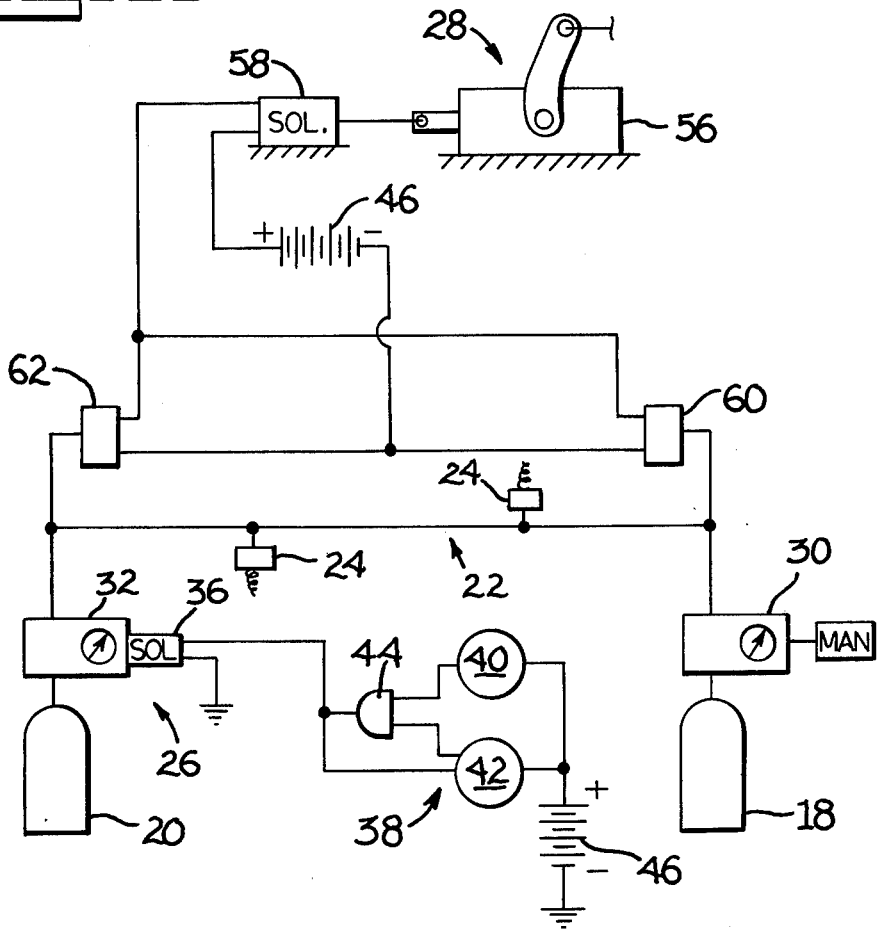
FIG. 3 is a schematic illustration of another embodiment of the present invention.
Figure 4:
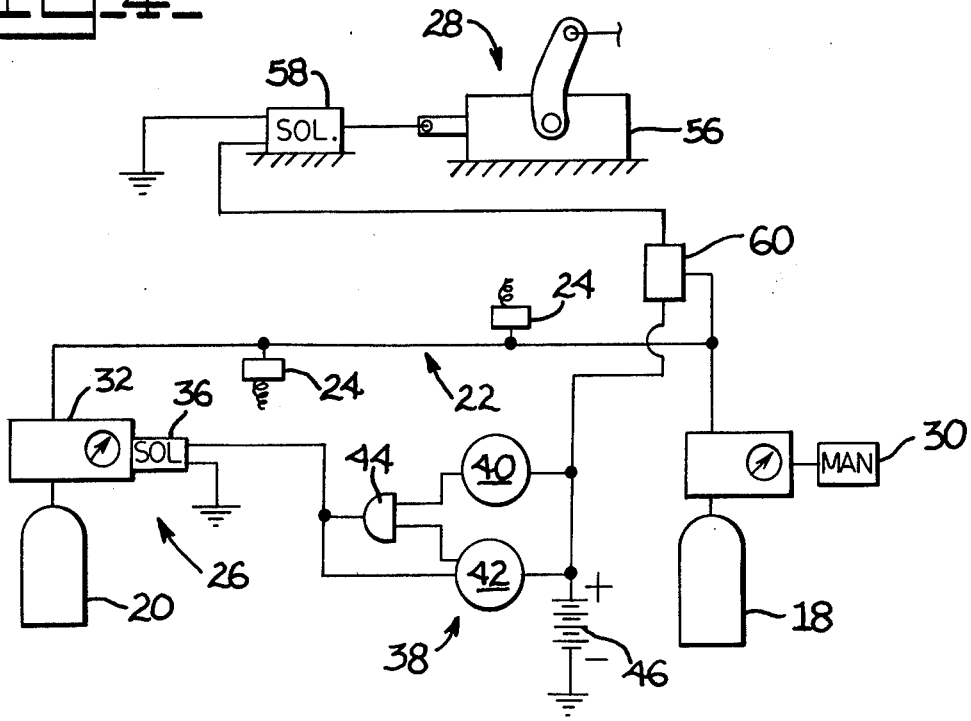
FIG. 4 is a schematic illustration of the present invention similar to FIG. 3.

Referring to FIGS. 2–4 the fire suppression system 10 includes a source of pressurized fire extinguishing fluid, preferably first and second spaced apart storage tanks 18, 20. The tanks 18, 20 contain a fire extinguishing fluid designed to extinguish particular types of fires. For a diesel fuel fire, the fluid is preferably Halon 1301, which is propelled by an inert propellant, preferably nitrogen. Halon 1301, Freon 1301 and Freon 13b1 are common names well known in the art for monobromotrifluoromethane, $CBrF_3$.

The fire suppression system 10 also includes means 22 for controllably directing the fire extinguishing fluid to preselected areas of the wheel loader 12, preferably the engine 14 and transmission 16. The directing means 22 includes at least one nozzle 24, preferably two, connected to the tanks 18, 20 and oriented towards the preselected areas. The nozzle 24 has a construction sufficient for projecting a preselected, shaped volume of fluid to the preselected areas in a given time period. The nozzle 24 is preferably a spiral nozzle which projects a solid cone of fluid.

The fire suppression system also includes means 26 for controllably releasing the fluid and means 28 for automatically stopping the engine 14, and thus stopping the wheel loader 12, and maintaining the engine 14 stopped in response to controlled release of the fluid.

Referring to FIG. 2, the releasing means 26 includes a first, manually operated valve 30 connected to the first tank 18 and preferably located on a side of the wheel loader 12 and easily accessible to an operator outside the wheel loader. The releasing means 26 includes a second valve 32 connected to the second tank 20 which is preferably manually operated and located on the wheel loader 12 and easily accessible to an operator inside the wheel loader 12.

The tanks 18, 20 are preferably connected to the directing means 22 by an isolating shuttle valve 34. The isolating valve 34 is of a construction sufficient for isolating a selected one of the tanks 18, 20 from the other during release of the fluid from only the selected tank. The fluid can also flow from both tanks 18, 20 through the valve 34 at the same time.

Referring to FIGS. 3–4, the second valve 32 can be automatically operated by a solenoid 36 which is energized by a fire detecting means 38. The fire detecting means 38 preferably includes a smoke detector 40, a heat sensor 42 and an AND circuit 44 which is connected to the smoke detector 40 and heat sensor 42. The AND circuit and heat sensor 42 are connected to the solenoid 36 and the smoke detector 40 and heat sensor 42 are connected to a power supply 46. The fire detecting means 38 energizes the solenoid 36 in response to the heat sensor 42 sensing a first preselected temperature and the smoke detector 40 detecting smoke and in response to the heat sensor 42 sensing a second preselected temperature. The first preselected temperature is less than the second preselected temperature.

Referring to FIG. 2, the stopping means 28 preferably includes a single-acting fluid motor, such as an air cylinder 48, for example. The air cylinder 48 is connected to the tanks 18, 20 by a valve, preferably a one-way check valve 50. The valve 50 is connected to a conduit 52 which connects the air cylinder 48 and the tanks 18, 20. The isolating valve 34 is connected between the tanks 18, 20 and check valve 50. The air cylinder 48 receives fluid through the check valve 50 and conduit 52.

The air cylinder 48 has a rod element 54 connected to the wheel loader 12 and movable between a first position at which the wheel loader 12 is operating and a second position at which the wheel loader 12 is stopped. The rod 54 is preferably connected to a governor control apparatus 56 of the engine 14 which controls the flow of fuel to the engine.

Figure 5:
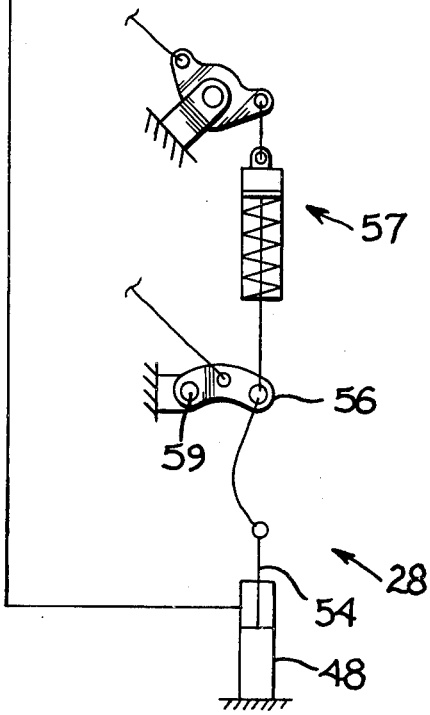
FIG. 5 is a diagrammatic view similar to FIG. 2.
Figure 5:
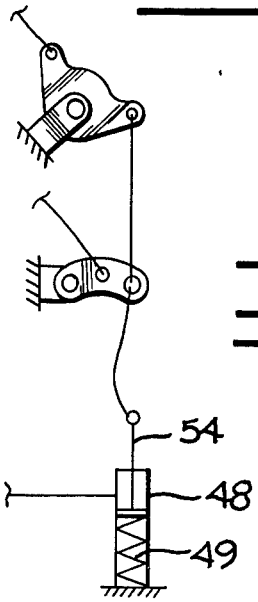

The governor control apparatus 56 preferably includes an extendable link 57 connected to a governor input shaft 59. The link 57 is manipulated by an operator to control the flow of fuel to the engine 14. The air cylinder 48 can be connected to the link 57 and manipulate the link 57 to shut off the engine 14. The air cylinder 48 can include a biasing means, preferably a spring 49, for urging the rod 54 toward the first position (FIG. 5).

Referring to FIGS. 3–4, the stopping means 28 can include a solenoid 58 for manipulating the governor control apparatus 56. The solenoid 58 is connected electrically in series with a first air switch 60 (FIG. 4) only or the first switch 60 and a second air switch 62 (FIG. 3). The switches 60, 62 are connected electrically one to the other in parallel and move from an open position to a closed poisition in response to release of the pressurized fluid. The switches 60, 62 remain closed until reset.

In operation, an operator manually releases fluid from one or both tanks 18, 20 in response to an engine 14 or transmission 16 fire. Fluid flows from the tanks 18, 20 through the isolating valve 34 and nozzles 24 to the engine 14 and transmission 16 to extinguish the fire (FIG. 2). Fluid flows through the check valve 50 and conduit 52 to urge the rod 54 of the air cylinder 48 towards the second position. The rod 54 manipulates the governor control 56 and stops the engine 14. The fluid in the conduit 52 and air cylinder is bleed and the system 10 is recharged and readied for operation.

Referring to FIGS. 3–4, the fire detecting means 38 detects a fire and energizes the solenoid 36. Fluid flows from the tanks 18, 20 to the fire and to the air switches 60, 62. The switches 60, 62 close and energize the solenoid 58 which manipulates the governor control 56 which stops the engine. The switches 60, 62 are reset and the system is recharged and readied for operation.

The engine 14 and the wheel 12 are stopped by the fire suppression system 10 in response to a fire and the flow of fuel to the engine 14 is stopped. The fluid floods the engine 14 and shuts off the air supply. The engine 14 remains stopped until the fire is extinguished and the system 10 is recharged.

Other aspects, objects and advantages will become apparent from a study of the specification, drawings and appended claims.

The embodiments of the invention in which an exclusive property or privilege is claimed are defined as follows:

1. A fire suppression system for a machine having an engine with a governor, comprising:

a source of pressurized fire extinguishing fluid;

means for controllably directing said fluid to preselected area of said machine;

means for controllably releasing said fluid; and means for automatically stopping said machine in response to controlled release of said fluid and maintaining said machine stopped, said machine remaining stopped until said fire suppression system is readied for operation said stopping means including a single-acting fluid motor having a moving element and being connected to said fluid source by a conduit, said moving element being connected to the governor and movable between a first position at which said engine and machine are operating and the governor is free to control operation of the engine and a second position at which the governor is overriden and said engine and machine are stopped, said moving element being biased toward the first position and movable to said second position in response to receiving fluid from said fluid source.

2. An apparatus, as set forth in claim 1, wherein said directing means includes at least one nozzle connected to said fluid source and oriented towards said machine.

3. An apparatus, as set forth in claim 1, including a one-way check valve connected to said conduit between said fluid motor and fluid source.

4. An apparatus, as set forth in claim 1, wherein said releasing means includes a manually operated valve connected to said fluid source.

5. An apparatus, as set forth in claim 1, wherein said releasing means includes a solenoid valve connected to said fluid source and a fire detecting means for automatically energizing said solenoid valve.

6. An apparatus, as set forth in claim 5, wherein said fire detecting means includes a smoke detector, a heat sensor, and an electric circuit connected to said smoke detector and heat sensor, said fire detection means energizing said solenoid valve in response to said heat sensor sensing a preselected temperature and said smoke detector detecting smoke.

7. An apparatus, as set forth in claim 1, including a second source of pressurized fire extinguishing fluid spaced from said first extinguishing source and connected to said first extinguishing source through a valve, said valve having a construction sufficient for isolating one of said fire extinguishing sources from the other during release of fluid from only one of said fire extinguishing sources.

8. An apparatus, as set forth in claim 1, wherein readying said fire suppression system for operation includes isolating the source of pressurized fire extinguishing fluid from the remainder of the system, purging the remainder of the system of pressurized fluid, and replinishing the fluid pressure source.

9. A fire suppression system for a machine having an engine with a governor comprising:

a source of pressurized fire extinguishing fluid;

means for controllably directing said fluid to preselected areas of said machine;

means for controllably releasing said fluid; and means for automatically stopping said machine in response to controlled release of said fluid and maintaining said machine stopped, said machine remaining stopped until said fire suppression system is readied for operation;

said stopping means including a solenoid operably connected to the governor, said solenoid being energized in response to the closing of a pressurized switch which closes in response to controlled release to the fluid and controllably manipulating the governor to stop the engine and machine.

* * * * *